US011559445B2

(12) United States Patent
Moore

(10) Patent No.: US 11,559,445 B2
(45) Date of Patent: Jan. 24, 2023

(54) SUPPORT DEVICES INCLUDING MOVABLE LEG SEGMENTS AND METHODS FOR OPERATING THE SAME

(71) Applicant: Toyota Motor North America, Inc., Plano, TX (US)

(72) Inventor: Douglas A. Moore, Fairview, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 343 days.

(21) Appl. No.: 16/860,516

(22) Filed: Apr. 28, 2020

(65) Prior Publication Data

US 2021/0330522 A1 Oct. 28, 2021

(51) Int. Cl.
*A61G 5/06* (2006.01)
*A61G 5/10* (2006.01)

(52) U.S. Cl.
CPC ..... *A61G 5/068* (2013.01); *A61G 5/104* (2013.01)

(58) Field of Classification Search
CPC ..... A61G 5/04; A61G 5/1078; A61G 5/068; A61G 5/061; A61G 5/104
See application file for complete search history.

(56) References Cited

U.S. PATENT DOCUMENTS

| | | | | |
|---|---|---|---|---|
| 5,314,238 | A | 5/1994 | Komorowski et al. | |
| 7,537,285 | B2 | 5/2009 | Stewart | |
| 8,087,728 | B2 | 1/2012 | Corcoran | |
| 10,912,691 | B2 * | 2/2021 | Cherny | A61G 5/006 |
| 2015/0168953 | A1 * | 6/2015 | Smid | G01S 5/14 701/28 |
| 2019/0365592 | A1 * | 12/2019 | Norton | A61H 3/04 |

FOREIGN PATENT DOCUMENTS

| | | | | |
|---|---|---|---|---|
| KR | 20190002000 | A | 1/2019 | |
| WO | 2012146898 | A1 | 11/2012 | |
| WO | 2018224751 | A1 | 12/2018 | |
| WO | WO-2021116871 | A1 * | 6/2021 | A61G 5/04 |

* cited by examiner

*Primary Examiner* — John D Walters
(74) *Attorney, Agent, or Firm* — Dinsmore & Shohl LLP

(57) ABSTRACT

A support device includes a wheel, a base member, a leg coupled to the wheel and the base member, the leg including an upper leg segment, a lower leg segment positioned below the upper leg segment, a joint positioned between the upper leg segment and the lower leg segment, the joint including a cam defining a non-circular perimeter, and an actuator coupled to one of the upper leg segment and the lower leg segment, the actuator including an engagement member that is engaged with the non-circular perimeter of the of the cam of the joint, where the actuator selectively moves the engagement member to move the cam and the upper leg segment and the lower leg segment about the joint.

20 Claims, 5 Drawing Sheets

SUPPORT DEVICES INCLUDING MOVABLE LEG SEGMENTS AND METHODS FOR OPERATING THE SAME

TECHNICAL FIELD

The present specification generally relates to support devices including movable leg segments and methods for operating the same.

BACKGROUND

Support devices, such as wheelchairs, assistive robots, mechanized walkers, and the like, are conventionally used to assist users in moving from one location to another. For example, motorized wheelchairs can move a user between locations, and assistive robots and mechanized walkers can provide support to a user moving between locations. In some instances, assistive robots and mechanized walkers may also assist a user in carrying objects between locations. Conventional support devices can include wheels that move along a surface, such as a floor or the ground, and can include legs coupled to the wheels. The legs may operate to move the support device upward and downward in the vertical direction, which can assist in moving the support device over uneven surfaces or obstacles.

SUMMARY

The inventor of the present disclosure has recognized that uneven torque may be applied to the legs of a support device while moving the support device in the vertical direction. Uneven torque may require excess energy to move the support device in the vertical direction, and may require oversized actuators to move the support device, thereby increasing cost and weight of the support device. Support devices according to embodiments described herein generally include an actuator engaged with a non-circular cam. Through engagement with the non-circular cam, the actuator can apply different torques to an upper leg segment and a lower leg segment of the support device, thereby moving a base member of the support device upward and downward.

In one embodiment, a support device includes a wheel, a base member, a leg coupled to the wheel and the base member, the leg including an upper leg segment, a lower leg segment positioned below the upper leg segment, a joint positioned between the upper leg segment and the lower leg segment, the joint including a cam defining a non-circular perimeter, and an actuator coupled to one of the upper leg segment and the lower leg segment, the actuator including an engagement member that is engaged with the non-circular perimeter of the of the cam of the joint, where the actuator selectively moves the engagement member to move the cam and the upper leg segment and the lower leg segment about the joint.

In another embodiment, a wheelchair includes a base member for supporting a person, a wheel, and a leg as coupled to the base member and the wheel, the leg including an upper leg segment, a lower leg segment positioned below the upper leg segment, a joint positioned between the upper leg segment and the lower leg segment and rotatably coupling the upper leg segment and the lower leg segment, the joint including a cam defining a non-circular perimeter, and an actuator coupled to one of the upper leg segment and the lower leg segment, the actuator including an engagement member that is engaged with the non-circular perimeter of the of the cam of the joint, where the actuator selectively moves the engagement member to move the cam and the upper leg segment and the lower leg segment about the joint.

In another embodiment, a method for moving a leg of a support device includes moving a wheel of a support device along a surface, where the support device includes an upper leg segment, a lower leg segment positioned below the upper leg segment, the wheel coupled to the lower leg segment, and a joint positioned between the upper leg segment and the lower leg segment, where the joint includes a cam defining a non-circular perimeter, and moving an engagement member engaged with the non-circular perimeter of the cam, thereby moving the lower leg segment with respect to the upper leg segment about the joint.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally directed to support devices including an upper leg segment and a lower leg segment coupled to the upper leg segment at a joint including a cam with a non-circular perimeter. In embodiments, the upper leg segment and the lower leg segment are movably coupled to one another at the joint, and can move a base member of the support device upward or downward in a vertical direction. Embodiments described herein include an actuator coupled to one of the upper leg segment and the lower leg segment, the actuator including an engagement member engaged with the non-circular perimeter of the cam of the joint. Through engagement with the non-circular perimeter of the cam, the engagement member may apply varying torques to the cam to overcome varying torques applied to the joint by the base member associated with the relative position of the base member. These and other embodiments will now be described with specific reference to the appended drawings.

Figure 1:
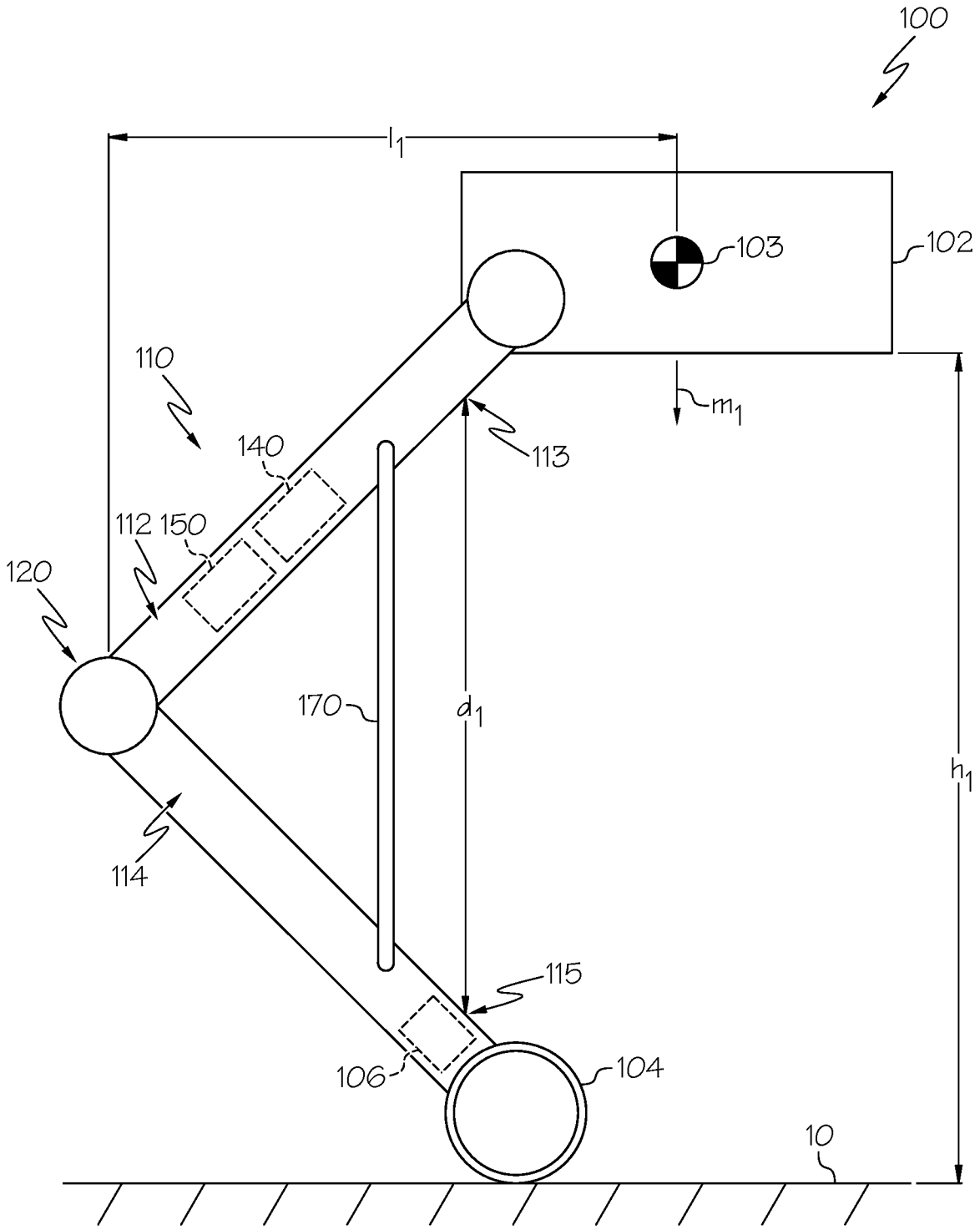
FIG. 1 schematically depicts a side view of a support device including an upper leg segment and a lower segment in an extended position, according to one or more embodiments shown and described herein.

Referring initially to FIG. 1 a side view of a support device 100 is schematically depicted. In embodiments, the support device 100 includes a base member 102. In some embodiments, the support device 100 is a wheelchair that supports a person, and the base member 102 may include a seat or the like. In some embodiments, the support device 100 may include an assistive robot, a mechanized walker, or the like, and the base member 102 may include a base of the robot or the mechanized walker. In some embodiments, the base member 102 may be structurally configured to carry items, for example groceries or other items that a user wishes to move from one location to another.

In embodiments, the support device 100 includes a leg 110 coupled to the base member 102, and a wheel 104 coupled to the leg 110. The wheel 104 is rotatably coupled to the leg 110 and may provide mobility to the support device 100 such that the support device 100 may move along a surface 10, such as the ground or a floor. The support device 100, in some embodiments, includes a wheel actuator 106 engaged with the wheel 104. The wheel actuator 106 rotates the wheel 104, and may provide the support device 100 with mobility along the surface 10. The wheel actuator 106 may include any suitable actuator to rotate the wheel 104, and may include for example and without limitation, a direct current (DC) motor, an alternating current (AC) motor, a hydraulic motor, a pneumatic motor, or the like.

Figure 2:
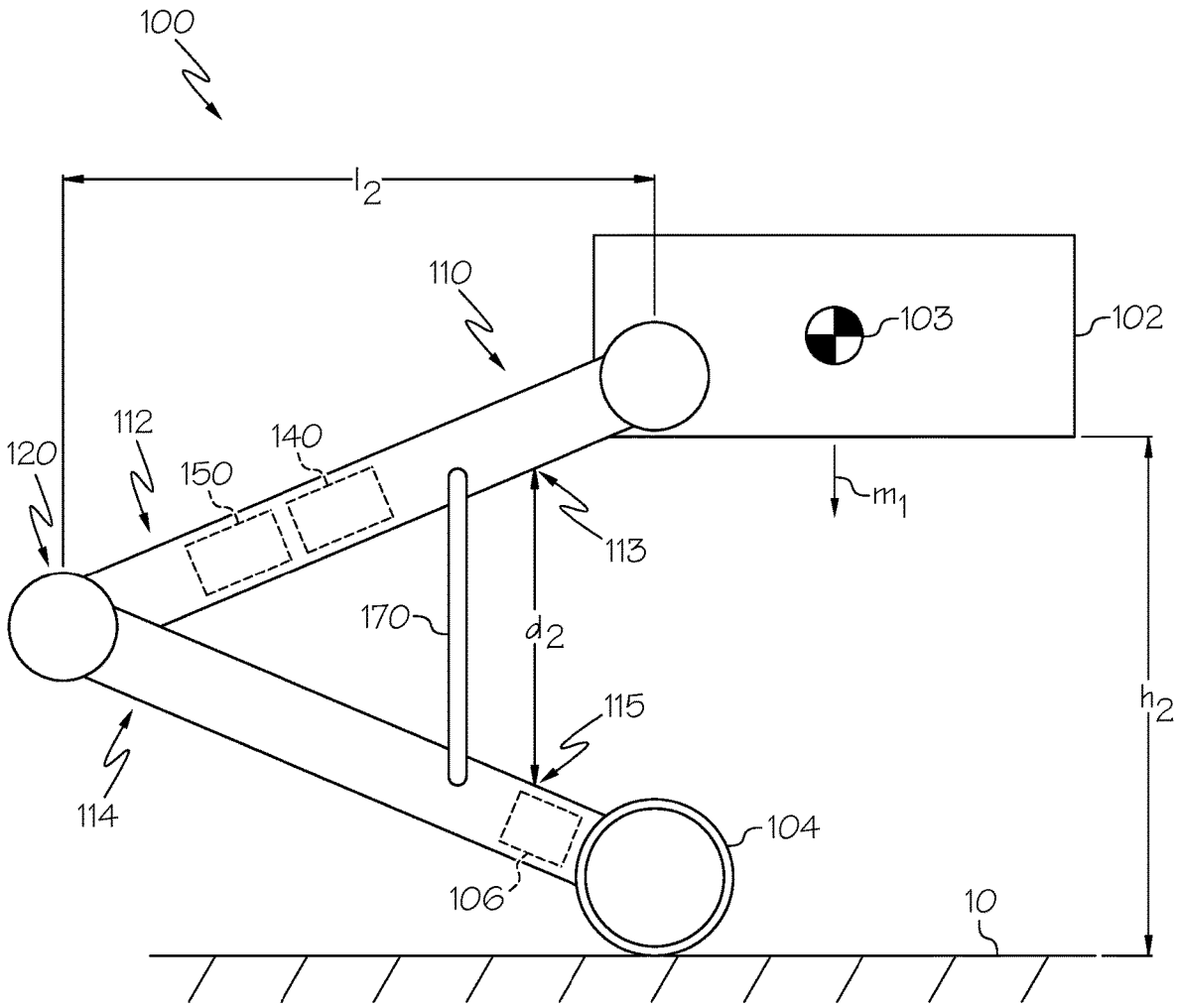
FIG. 2 schematically depicts a side view of the support device of FIG. 1 with the upper leg segment and the lower segment in a retracted position, according to one or more embodiments shown and described herein.

In embodiments, the leg 110 includes an upper leg segment 112 and a lower leg segment 114 positioned below the upper leg segment 112. The leg 110 further includes a joint 120 positioned between the upper leg segment 112 and the lower leg segment 114. The upper leg segment 112 and the lower leg segment 114 are rotatably coupled at the joint 120, such that the upper leg segment 112 and the lower leg segment 114 are positionable between an extended position, as depicted in FIG. 1, and a retracted position, as depicted in FIG. 2. In the extended position as depicted in FIG. 1, a portion 113 of the upper leg segment 112 is spaced apart from a portion 115 of the lower leg segment 114 by a distance d1. In the retracted position and as shown in FIG. 2, the portion 113 of the upper leg segment 112 is spaced apart from the portion 115 of the lower leg segment 114 by a distance d2, where the distance d2 is less than the distance d1 (FIG. 1). By moving the upper leg segment 112 and the lower leg segment 114 between the extended position (FIG. 1) and the retracted position (FIG. 2), the base member 102 can be raised or lowered with respect to the surface 10. For example, with the upper leg segment 112 and the lower leg segment 114 in the extended position (FIG. 1), the base member 102 is positioned above the surface 10 by a height h1. By contrast, with the upper leg segment 112 and the lower leg segment 114 in the retracted position (FIG. 2), the base member 102 is positioned above the surface by a height h2, where the height h2 is less than the height h1 (FIG. 1). By raising or lowering the base member 102 with respect to the surface 10, a person (e.g., a user) sitting on or engaged with the base member 102 support device 100 may be raised or lowered as desired.

Further, in embodiments, by moving the upper leg segment 112 and the lower leg segment 114 between the extended position and the retracted position, the wheel 104 may be drawn upward toward, or lowered away from the base member 102. By raising or lowering the wheel 104 with respect to the base member 102, the support device 100 may accommodate obstacles, such as stairs, curbs, or the like. While in the side views depicted in FIGS. 1 and 2 show the support device 100 as including a single leg 110, it should be understood that support devices 100 described herein may include any suitable number of legs. For example, in embodiments, the support device 100 may include two legs 110 (i.e., in a bicycle configuration) and may balance using gyroscopes or the like. In some embodiments, the support device 100 may include three legs 110 (i.e., in a tricycle configuration), or may include four or more legs 110. In embodiments including multiple legs, each of the legs can be similar to the leg 110 depicted in FIGS. 1 and 2, or in some embodiments, the support device 100 may include one or more legs or wheels coupled to the base member 102 that include a different configuration than the leg 110. For example, in some embodiments, the support device 100 may include one or more legs or wheels coupled to the base member 102 that do not include the upper leg segment 112 and the lower leg segment 114, or one or more legs that are rigidly coupled to the base member 102 and are not generally movable in a vertical direction with respect to the base member 102.

In embodiments, the support device 100 includes an actuator 140 coupled to one of the upper leg segment 112 and the lower leg segment 114. In some embodiments, the actuator 140 is a first actuator 140, and the support device 100 includes a second actuator 150. In the embodiment depicted in FIG. 1, the first actuator 140 and the second actuator 150 are coupled to the upper leg segment 112, however it should be understood that this is merely an example. For example, in embodiments, the first actuator 140 and the second actuator 150 can be coupled to the lower leg segment 114, or in some embodiments, the first actuator 140 may be coupled to one of the upper leg segment 112 or the lower leg segment 114 while the second actuator 150 is coupled to the other of the upper leg segment 112 and the lower leg segment 114. The first actuator 140 and the second actuator 150 move the upper leg segment 112 and the lower leg segment 114 about the joint 120, as described in greater detail herein. While in the embodiment depicted in FIG. 1, the support device 100 includes the first actuator 140 and the second actuator 150, it should be understood that in some embodiments, the support device 100 may include a single actuator, or may include more than two actuators.

In some embodiments, the support device 100 includes a spring 170 coupled to the upper leg segment 112 and the lower leg segment 114. The spring 170 may include a gas spring or the like that generally resists force applied to the spring 170, thereby assisting in maintaining the position of the upper leg segment 112 with respect to the lower leg segment 114.

Figure 3A:
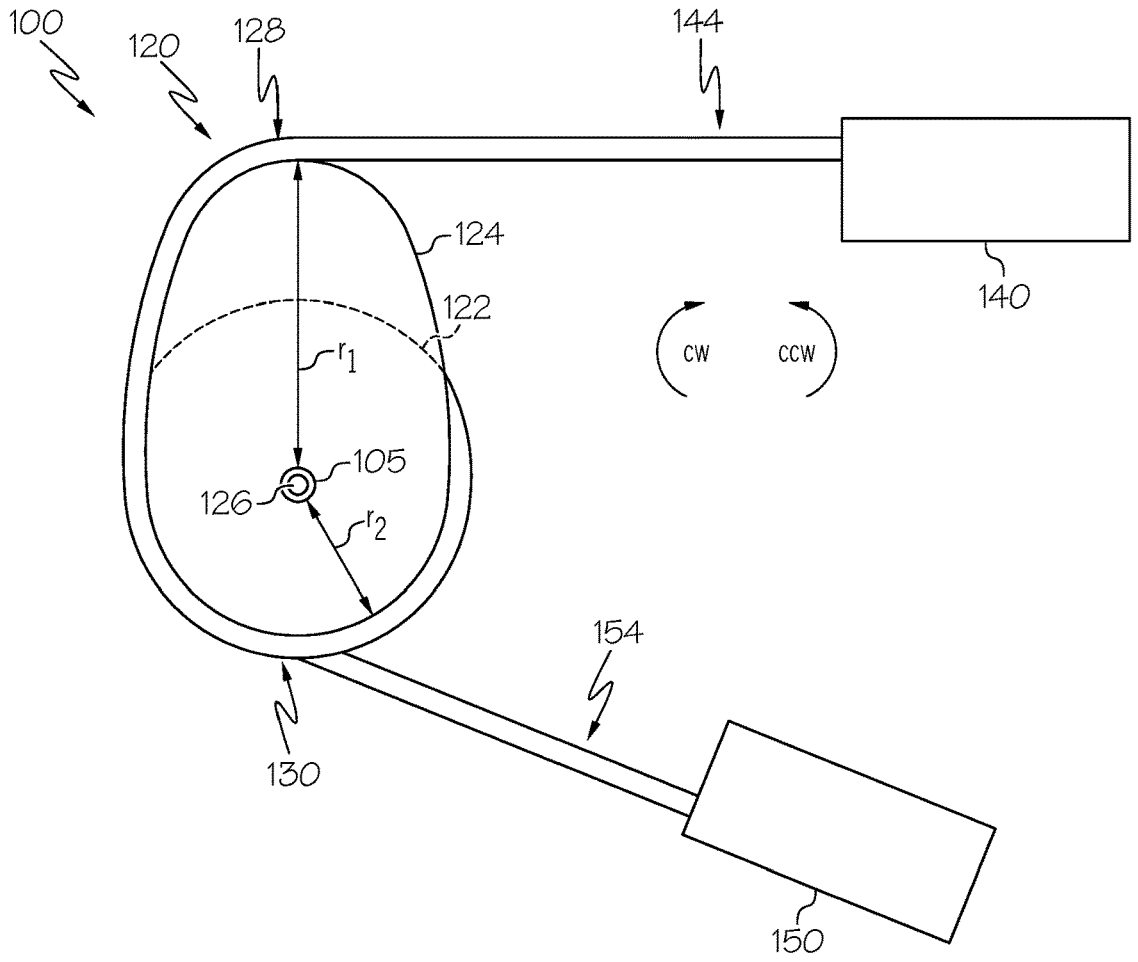
FIG. 3A schematically depicts a side view of a first actuator and a second actuator of the support device of FIG. 1, according to one or more embodiment shown and described herein.
Figure 3B:
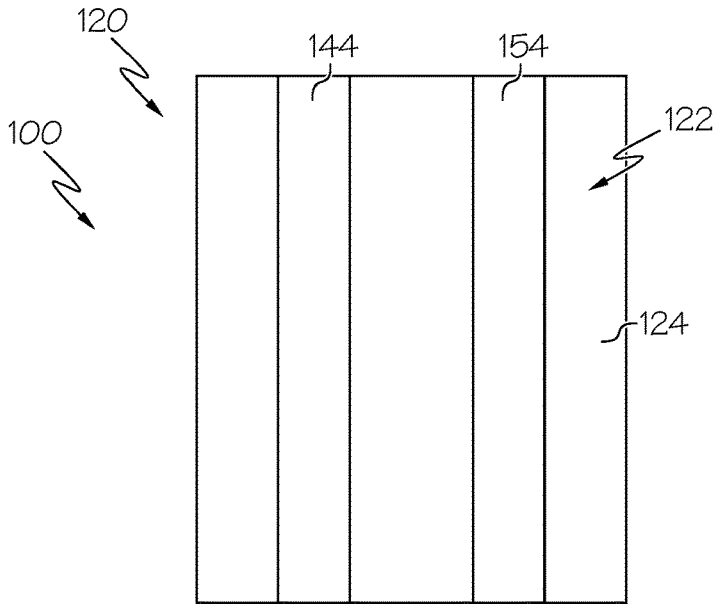
FIG. 3B schematically depicts a side view of a cam of the support device of FIG. 1, according to one or more embodiments shown and described herein.

Referring to FIGS. 3A and 3B, a side view and a front view of the joint 120 are schematically depicted. The joint 120 generally includes a cam 122 that defines a non-circular perimeter 124. For example in the embodiment depicted in FIGS. 3A and 3B, the cam 122 includes an oval or egg-shape. In particular, in the embodiment depicted in FIGS. 3A and 3B, the cam 122 defines a rotational axis 126 about which the cam 122 rotates. The cam 122 further defines a lobe 128 that is spaced apart from the rotational axis 126 by a lobe distance r1, and an inner point 130 that is spaced apart from the rotational axis 126 by a base circle radius r2, where the lobe distance r1 is greater than the base circle radius r2. While in the embodiment depicted in FIGS. 3A and 3B, the cam 122 includes an oval shape with a single lobe 128 extending outward from the rotational axis 126, it should be understood that this is merely an example. For example, in some embodiments, the cam 122 may include multiple lobes extending outward from the rotational axis 126, and each of the lobes may extend outward from the rotational axis 126 by the same lobe distance r1 or may extend outward from the rotational axis 126 by distances that are greater than or less than the lobe distance d1.

In embodiments, the cam 122 is rigidly coupled to the lower leg segment 114 (FIG. 1), such that rotation of the cam 122 causes the lower leg segment 114 (FIG. 1) to rotate about the joint 120 (FIG. 1). For example, as the cam 122 rotates in the clockwise direction as depicted, the lower leg segment 114 (FIG. 1) rotates about the joint 120 (FIG. 1) in the clockwise direction, and as the cam 122 rotates in the counter-clockwise direction as depicted, the lower leg segment 114 (FIG. 1) rotates about the joint 120 (FIG. 1) in the counter clockwise direction. Further, in embodiments, the upper leg segment 112 (FIG. 1) is rotatably coupled to the base member 102 (FIG. 1), such that the upper leg segment 112 (FIG. 1) moves about the joint 120 as the cam 122 and the lower leg segment 114 (FIG. 1) rotate.

In some embodiments, for example in embodiments in which the first actuator 140 and the second actuator 150 are coupled to the lower leg segment 114 (FIG. 1), the cam 122 is rigidly coupled to the upper leg segment 112 (FIG. 1). In these embodiments, as the cam 122 rotates in the clockwise direction as depicted, the upper leg segment 112 (FIG. 1) rotates about the joint 120 (FIG. 1) in the clockwise direction, and as the cam 122 rotates in the counter-clockwise direction as depicted, the upper leg segment 112 (FIG. 1) rotates about the joint 120 (FIG. 1) in the counter-clockwise direction. Further, because the lower leg segment 114 (FIG. 1) is rotatably coupled to the upper leg segment 112 (FIG. 1) at the joint 120, the lower leg segment 114 (FIG. 1) moves as the upper leg segment 112 (FIG. 1) and the cam 122 rotate.

In some embodiments, the cam 122 is selectively engaged with the upper leg segment 112 (FIG. 1) and the lower leg segment 114 (FIG. 1), for example, in embodiments in which the first actuator 140 is coupled to one of the upper leg segment 112 (FIG. 1) or the lower leg segment 114 (FIG. 1), and the second actuator 150 is coupled to the other of the upper leg segment 112 (FIG. 1) and the lower leg segment 114 (FIG. 1). In these embodiments, when the cam 122 rotates in the clockwise direction as depicted, the cam 122 engages the lower leg segment 114 (FIG. 1), such that the lower leg segment 114 (FIG. 1) rotates about the joint 120 in the clockwise direction as depicted. By contrast, when the cam 122 rotates in the counter-clockwise direction as depicted, the cam 122 engages the upper leg segment 112 (FIG. 1), such that the upper leg segment 112 (FIG. 1) rotates about the joint 120 in the counter-clockwise direction. Through selective engagement with the upper leg segment 112 (FIG. 1) and the lower leg segment 114 (FIG. 1), the first actuator 140 and the second actuator 150 can move the upper leg segment 112 (FIG. 1) and the lower leg segment 114 (FIG. 1) about the joint 120 (FIG. 1). In embodiments, the cam 122 may be selectively engaged with the upper leg segment 112 (FIG. 1) and the lower leg segment 114 (FIG. 1) through any suitable device, for example and without limitation one-way ratchets or the like.

In embodiments, the first actuator 140 includes a first engagement member 144 that is engaged with the non-circular perimeter 124 of the cam 122 of the joint 120. In the embodiment depicted in FIGS. 3A and 3B, the second actuator 150 includes a second engagement member 154 that is engaged with the non-circular perimeter 124 of the cam 122 of the joint 120. In the embodiment depicted in FIGS. 3A and 3B, the first engagement member 144 and the second engagement member 154 are flexible members that are wrapped around at least a portion of the non-circular perimeter 124 of the cam 122. For example and without limitation, the first engagement member 144 and the second engagement member 154 may include belts, straps, chains, or the like that wrap at least partially around the non-circular perimeter 124 of the cam 122. The first actuator 140 and the second actuator 150 selectively pay out or take up the first engagement member 144 and the second engagement member 154, respectively, causing the cam 122 to rotate, which thereby moves the leg 110 (FIG. 1) between the extended position (FIG. 1) and the retracted position (FIG. 2).

For example and referring to FIGS. 1-3B, to move the upper leg segment 112 and the lower leg segment 114 from the retracted position (FIG. 2) to the extended position (FIG. 1), the first actuator 140 draws the first engagement member 144 toward the actuator 140, thereby causing the cam 122 to rotate in the clockwise direction as depicted. As noted above, in embodiments, the cam 122 may be coupled to the lower leg segment 114, such that as the cam 122 rotates in the clockwise direction, the lower leg segment 114 rotates in the clockwise direction about the joint 120, thereby moving the upper leg segment 112 and the lower leg segment 114 into the extended position as shown in FIG. 1. In embodiments that include the second actuator 150, as the cam 122 rotates in the clockwise direction, the second actuator 150 may pay out the second engagement member 154, such that the second engagement member 154 wraps around the cam 122 as the cam 122 rotates in the clockwise direction.

Conversely, to move the upper leg segment 112 and the lower leg segment 114 from the extended position (FIG. 1) to the retracted position (FIG. 2), in embodiments, the second actuator 150 draws the second engagement member 154 toward the second actuator 150, thereby causing the cam 122 to rotate in the counter-clockwise direction as depicted. As noted above, in embodiments, the cam 122 may be coupled to the lower leg segment 114, such that as the cam 122 rotates in the counter-clockwise direction, the lower leg segment 114 rotates in the counter-clockwise direction about the joint 120, thereby moving the upper leg segment 112 and the lower leg segment 114 into the retracted position as shown in FIG. 2. As the cam 122 rotates in the counter-clockwise direction, the first actuator 140 may pay out the first engagement member 144, such that the first engagement member 144 wraps around the cam 122 as the cam 122 rotates in the clockwise direction.

In embodiments that do not include the second actuator 150, the weight of the base member 102 may cause the upper leg segment 112 and the lower leg segment 114 move to the retracted position. For example, in embodiments that do not include the second actuator 150, the first actuator 140 may pay out the first engagement member 144, allowing the cam 122 and the lower leg segment 114 to rotate in the counter-clockwise direction as a result of gravitational forces acting on the base member 102. In some embodiments, the support device 100 includes a biasing member 105 engaged with the cam 122 that biases the cam 122 to move the upper leg segment 112 and the lower leg segment 114 into the retracted position.

In embodiments, the weight of the base member 102 (FIG. 1) applies different torques to the joint 120 (FIG. 1) depending on the position of the leg 110. For example and referring to FIG. 1, with the upper leg segment 112 and the lower leg segment 114 in the extended position, the base member 102 applies a torque to the joint according the following equation:

$$T1=m1*l1$$

In the above equation, m1 is force associated with the mass of the base member 102 (e.g., the mass of the base member 102*gravitational constant), l1 is a distance between a center of mass 103 of the base member 102 and the joint 102, and T1 is the torque applied to the joint 102.

By contrast and referring to FIG. 2, with the upper leg segment 112 and the lower leg segment 114 in the retracted position, the center of mass 103 of the base member 102 is farther away from the joint, and the base member 102 applies a torque to the joint 120 according to the following equation:

$$T2=m1*l2$$

In the above equation, m1 is force associated with the mass of the base member 102 (e.g., the mass of the base member 102*gravitational constant), l2 is a distance between the center of mass 103 of the base member 102 and the joint 102, and T2 is the torque applied to the joint 102. As depicted in FIGS. 1 and 2, the distance 12 between the center of mass 103 of the base member 102 and the joint 120 with the upper leg segment 112 and the lower leg segment 114 in the retracted position (FIG. 2) is greater than the distance 11 between the center of mass 103 of the base member and the joint 120 with the upper leg segment 112 and the lower leg segment 114 in the extended position (FIG. 1). Accordingly, the torque T1 on the joint 120 associated with the mass of the base member 102 with the leg 110 in the extended position (FIG. 1) is less than the torque T2 on the joint 120 associated with the mass of the base member 102 with the leg 110 in the retracted position (FIG. 2).

Through the non-circular perimeter 124 (FIG. 3A) of the cam 122 (FIG. 3A), the first actuator 140 and the second actuator 150 may apply different torques to the joint 120 to accommodate the different torques acting on the joint 120 with the leg 110 in the extended position (FIG. 1) and in the retracted position (FIG. 2). For example and referring to FIG. 3A, in embodiments, the first engagement member 144 applies force to the lobe 128 of the cam 122 when the upper leg segment 112 and the lower leg segment 114 are in the retracted position (FIG. 2).

Referring particularly to FIGS. 2 and 3A, in embodiments, the first engagement member 144 engages and applies force to the lobe 128 of the cam 122 when the upper leg segment 112 and the lower leg segment 114 are in the retracted position (FIG. 2) to move the upper leg segment 112 and the lower leg segment 114 to the extended position (FIG. 1). For example, as shown in FIG. 3A, the first engagement member 144 is engaged with and extends outward from the lobe 128, thereby applying force to the cam 122 at the lobe 128. Accordingly when the upper leg segment 112 and the lower leg segment 114 are in the retracted position, the first actuator 140, through the first engagement member 144 applies a torque to the cam 122 according to the following equation:

$$T3=f*r1$$

In the above equation T3 is the torque applied to the cam 122 by the first engagement member 144, f is the force applied to the cam 122 by the first engagement member 144, and r1 is the lobe distance.

However and referring to FIGS. 1 and 3A, in embodiments, the second engagement member 154 engages and applies force to the inner point 130 of the cam 122 when the upper leg portion 112 and the lower leg portion 114 are in the extended position (FIG. 1) to move the upper leg portion 112 and the lower leg portion 114 to the retracted position (FIG. 2). For example, as shown in FIG. 3A, the second engagement member 154 is engaged with and extends outward from the inner point 130, thereby applying force to the cam 122 at the inner point 130. Accordingly when the upper leg segment 112 and the lower leg segment 114 are in the extended position, the second actuator 150, through the second engagement member 154, applies a torque to the cam 122 according to the following equation:

$$T4=f*r2$$

In the above equation T4 is the torque applied to the cam 122 by the second engagement member 154, f is the force applied to the cam 122 by the second engagement member 154, and r2 is base circle radius.

As noted above, the base circle radius r2 is less than the lobe distance r1, and accordingly torque T3 is greater than torque T3 when the same force f is applied to the cam 122. In this way, the first actuator 140 and the second actuator 150 can apply different torques to the cam 122 depending on the position of the upper leg segment 112 and the lower leg segment 114, while the first actuator 140 and the second actuator 150 apply the same amount of force f. As such, by aligning the cam 122 such that the first actuator 140 and/or the second actuator 150 engage the lobe 128 when the upper leg segment 112 and the lower leg segment 114 are in the retracted position (FIG. 2), greater torque can be applied to move the upper leg segment 112 and the lower leg segment 114 to the extended position to overcome the comparatively large torque T1 associated with the weight of the base member 102. By contrast, by engaging an inner point 130 of the cam 122 when the upper leg segment 112 and the lower leg segment 114 are in the extended position (FIG. 1), comparatively lower torque is applied to move the upper leg segment 112 and the lower leg segment 114.

Figure 3C:
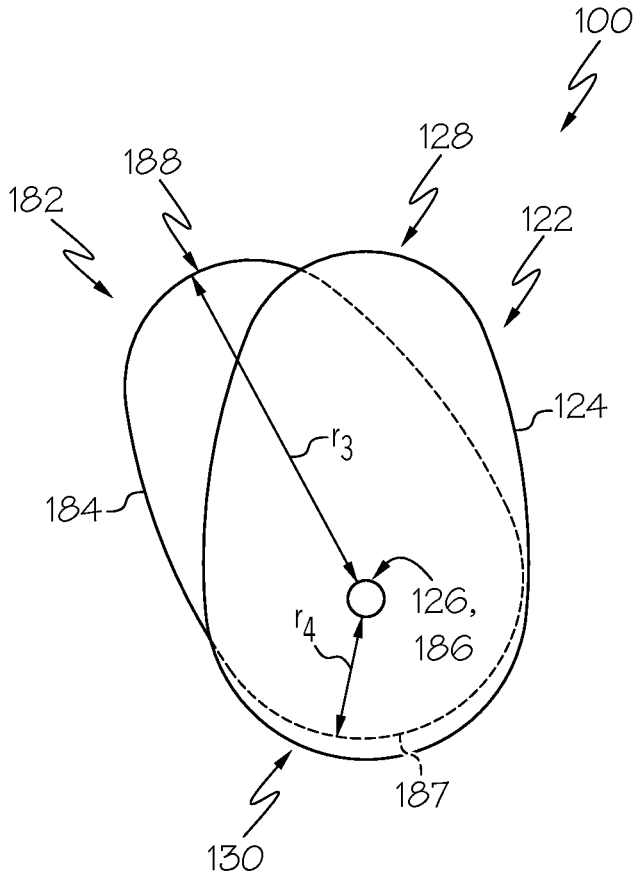
FIG. 3C schematically depicts a side view of a pair of cams of a support device, according to one or more embodiments shown and described herein.

Referring to FIG. 3C, in some embodiments, the cam 122 is a first cam 122, and the support device 100 includes a second cam 182. The second cam 182 may include a second non-circular perimeter 184 and may define a second lobe 188 extending outward from a second rotational axis 186 of the second cam 182. Similar to the first lobe 128 of the first cam 122, the second lobe 188 of the second cam 182 extends outward from the second rotational axis 186 by a lobe distance r3 that is greater than a base circle radius r4 extending between the second rotational axis 186 and an second inner point 187 of the second cam 182. In some embodiments, the first engagement member 144 (FIG. 3A) of the first actuator 140 (FIG. 3A) is engaged with the first cam 122, and the second engagement member 154 (FIG. 3A) of the second actuator 150 (FIG. 3A) is engaged with the second cam 182. As depicted in FIG. 3C, by utilizing different cams 122, 182, the second lobe 128, 188 of the first and second cam 122, 182 may be offset from one another. In this way, the first actuator 140 (FIG. 3A) and the second actuator 150 (FIG. 3A) can apply different torques at different rotational positions of the cams 122, 182.

Figure 4:
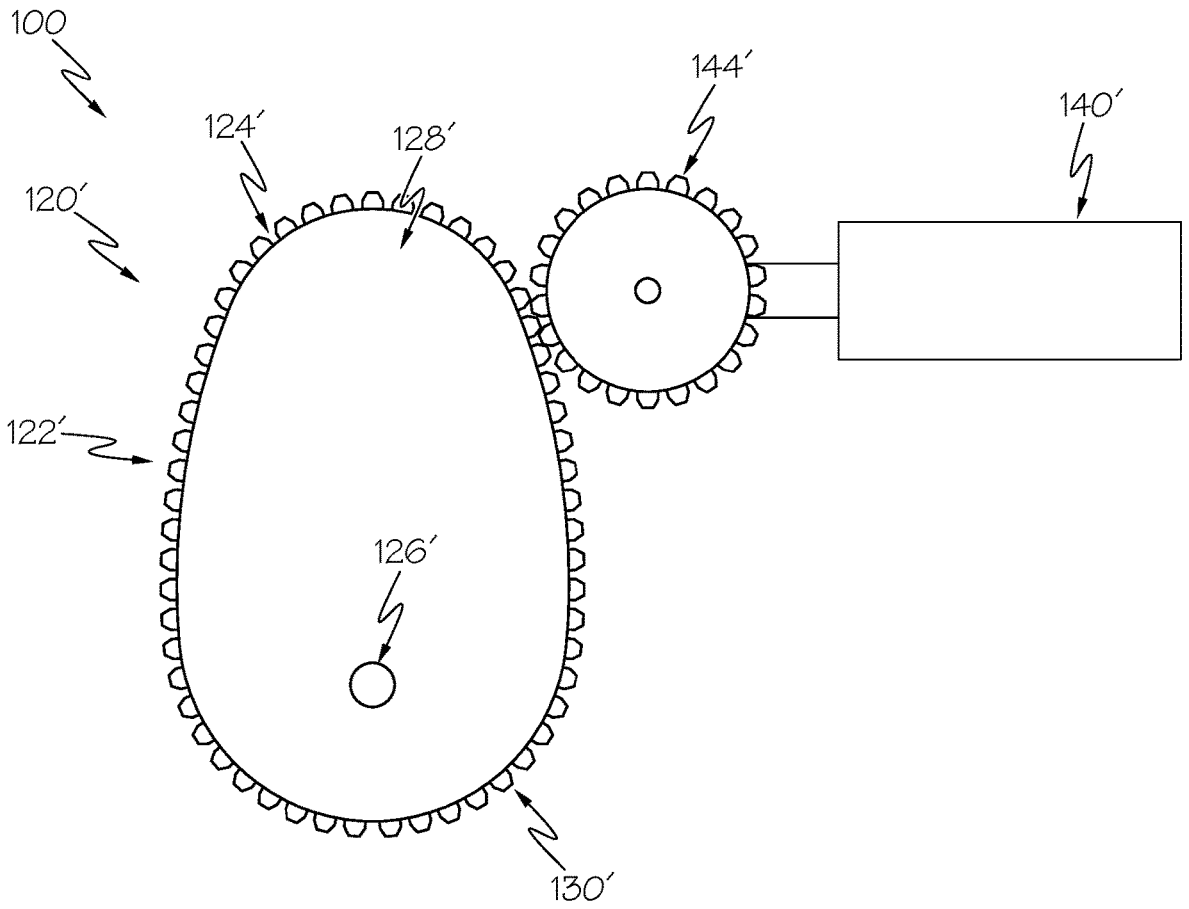
FIG. 4 schematically depicts another cam of a support device, according to one or more embodiments shown and described herein.

In some embodiments, the engagement member or engagement members of the actuators may be rigid members engaged with the cam or cams. For example and referring to FIG. 4, in some embodiments, the engagement member 144' of the actuator 140 is a gear engaged with the cam 120. Similar to the embodiments described above, the cam 122' includes the non-circular perimeter 124', and accordingly, different torques can be applied to the cam 122' by the engagement member 144' as the engagement member 144' applies force to different portions of the cam 122'. In particular, the engagement member 144' may engage and apply force to the lobe 128' of the cam 122' when the upper leg segment 112 (FIG. 1) and the lower leg segment 114 (FIG. 1) are in the retracted position (FIG. 2), while engaging and applying force to the inner point 130' of the cam 122' when the upper leg segment 112 (FIG. 1) and the lower leg segment 114 (FIG. 1) are in the extended position (FIG. 1).

It should now be understood that embodiments described herein are directed to support devices including an upper leg segment and a lower leg segment coupled to the upper leg segment at a joint including a cam with a non-circular perimeter. In embodiments, the upper leg segment and the lower leg segment are movably coupled to one another at the joint, and can move a base member of the support device upward or downward in a vertical direction. Embodiments described herein include an actuator coupled to one of the upper leg segment and the lower leg segment, the actuator including an engagement member engaged with the non-circular perimeter of the cam of the joint. Through engagement with the non-circular perimeter of the cam, the engagement member may apply varying torques to the cam to overcome varying torques applied to the joint by the base member associated with the relative position of the base member.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A support device comprising:

a wheel;

a base member;

a leg coupled to the wheel and the base member, the leg comprising:

an upper leg segment;

a lower leg segment positioned below the upper leg segment;

a joint positioned between the upper leg segment and the lower leg segment and rotatably coupling the upper leg segment and the lower leg segment, the joint comprising a cam defining a non-circular perimeter; and an actuator coupled to one of the upper leg segment and the lower leg segment, the actuator comprising an engagement member that is engaged with the non-circular perimeter of the of the cam of the joint, wherein the actuator selectively moves the engagement member to move the cam and the upper leg segment and the lower leg segment about the joint.

2. The support device of claim 1, wherein the engagement member comprises a flexible member that is wrapped around at least a portion of the non-circular perimeter of the cam.

3. The support device of claim 1, wherein the engagement member comprises a gear engaged with the non-circular perimeter of the cam.

4. The support device of claim 1, wherein:

the joint defines a rotational axis and the upper leg segment and the lower leg segment rotate with respect to one another about the rotational axis; and the non-circular perimeter of the cam defines a lobe and an inner point that is positioned closer to the rotational axis that the lobe.

5. The support device of claim 4, wherein the lower leg segment and the upper leg segment are positionable between an extended position and a retracted position, wherein the lower leg segment and the upper leg segment are positioned closer to one another in the retracted position as compared to the extended position.

6. The support device of claim 5, wherein the engagement member engages and applies force to the lobe of the cam when the upper leg segment and the lower leg segment are in the retracted position.

7. The support device of claim 5, wherein the engagement member and applies force to the inner point of the cam when the upper leg segment and the lower leg segment are in the extended position.

8. The support device of claim 1, wherein the actuator is a first actuator and the engagement member is a first engagement member, and the support device further comprises a second actuator comprising a second engagement member engaged with the cam of the joint.

9. The support device of claim 8, wherein the first engagement member and the second engagement member are flexible members and each are wrapped around at least a portion of the non-circular perimeter of the cam of the joint.

10. The support device of claim 8, wherein the cam is a first cam, and the joint further comprises a second cam, and wherein the first engagement member is engaged with the first cam and the second engagement member is engaged with the second cam.

11. The support device of claim 10, wherein the first cam defines a first lobe and the second cam defines a second lobe, and wherein the first lobe and the second lobe are angularly offset from one another.

12. The support device of claim 1, further comprising a biasing member engaged with the cam.

13. A wheelchair comprising:

a base member for supporting a person;

a wheel; and a leg as coupled to the base member and the wheel, the leg comprising:

an upper leg segment;

a lower leg segment positioned below the upper leg segment;

a joint positioned between the upper leg segment and the lower leg segment and rotatably coupling the upper leg segment and the lower leg segment, the joint comprising a cam defining a non-circular perimeter; and an actuator coupled to one of the upper leg segment and the lower leg segment, the actuator comprising an engagement member that is engaged with the non-circular perimeter of the of the cam of the joint, wherein the actuator selectively moves the engagement member to move the cam and the upper leg segment and the lower leg segment about the joint.

14. The wheelchair of claim 13, wherein:

the joint defines a rotational axis and the upper leg segment and the lower leg segment rotate with respect to one another about the rotational axis; and the non-circular perimeter of the cam defines a lobe and an inner point that is positioned closer to the rotational axis that the lobe.

15. The wheelchair of claim 14, wherein the lower leg segment and the upper leg segment are positionable between an extended position and a retracted position, wherein the lower leg segment and the upper leg segment are positioned closer to one another in the retracted position as compared to the extended position.

16. The wheelchair of claim 15, wherein the engagement member engages and applies force to the lobe of the cam when the upper leg segment and the lower leg segment are in the retracted position.

17. The wheelchair of claim 15, wherein the engagement member and applies force to the inner point of the cam when the upper leg segment and the lower leg segment are in the extended position.

18. A method for moving a leg of a support device, the method comprising:

moving a wheel of a support device along a surface, wherein the support device comprises an upper leg segment, a lower leg segment positioned below the upper leg segment, the wheel coupled to the lower leg segment, and a joint positioned between the upper leg segment and the lower leg segment, wherein the joint comprises a cam defining a non-circular perimeter; and moving an engagement member engaged with the non-circular perimeter of the cam, thereby moving the lower leg segment with respect to the upper leg segment about the joint.

19. The method of claim 18, wherein the engagement member comprises a flexible member that wraps at least partially around the non-circular perimeter of the cam, and moving the engagement member comprises taking up the engagement member from the cam.

20. The method of claim 18, wherein the engagement member comprises a gear engaged with the non-circular perimeter of the cam, and moving the engagement member comprises rotating the engagement member, thereby rotating the cam.

* * * * *